US006298777B1

(12) United States Patent
Dubois et al.

(10) Patent No.: US 6,298,777 B1
(45) Date of Patent: Oct. 9, 2001

(54) PORTABLE HAND-HELD MANUALLY OPERATED DRY PRINTING APPARATUS

(75) Inventors: Constant Dubois, 9 Boucher, Hull, Quebec (CA), J84 6G2; André Lafleur, Boucherville (CA); Pierre Patenaude, Montreal (CA); Eric Bussiere, Ste-Julie (CA)

(73) Assignee: Constant Dubois, Quebec (CA)

( * ) Notice: Subject to any disclaimer, the term of this patent is extended or adjusted under 35 U.S.C. 154(b) by 0 days.

(21) Appl. No.: 09/529,355

(22) PCT Filed: Aug. 20, 1999

(86) PCT No.: PCT/CA99/00783

§ 371 Date: Apr. 13, 2000

§ 102(e) Date: Apr. 13, 2000

(87) PCT Pub. No.: WO00/10807

PCT Pub. Date: Mar. 2, 2000

(30) Foreign Application Priority Data

Aug. 21, 1998 (CA) ..... 2245477

(51) Int. Cl.[7] ..... B31F 1/07

(52) U.S. Cl. ..... 101/27; 101/9; 101/41; 101/109

(58) Field of Search ..... 101/9, 10, 27, 101/41, 103, 108, 109, 112, 327, 333, 368; 156/230, 238, 277, 542

(56) References Cited

U.S. PATENT DOCUMENTS

| | | | |
|---|---|---|---|
| 1,726,575 | 9/1929 | Luedtke et al. . | |
| 1,909,844 | 5/1933 | Brenner . | |
| 3,195,450 * | 7/1965 | Sciame | 101/9 |
| 3,575,106 | 4/1971 | Collins | 101/41 |
| 3,975,226 | 8/1976 | Boettcher | 156/358 |
| 4,181,560 | 1/1980 | Maitland . | |
| 4,594,943 * | 6/1986 | Nettesheim et al. | 101/327 |
| 4,628,810 | 12/1986 | Chan . | |
| 4,904,334 | 2/1990 | Honma et al. . | |
| 5,694,844 * | 12/1997 | Taira | 101/125 |

FOREIGN PATENT DOCUMENTS

| | | |
|---|---|---|
| 10 15 016 B | 9/1957 | (DE) . |
| 33 15 338 A1 | 10/1984 | (DE) . |
| 2 042 984 A | 10/1980 | (GB) . |
| 2 145 036 A | 12/1983 | (GB) . |

* cited by examiner

*Primary Examiner*—Ren Yan
(74) *Attorney, Agent, or Firm*—Goudreau Gage Dubuc

(57) ABSTRACT

The dry printing apparatus comprises a housing defining a handle portion, a dry printing unit mounted to an open lower end of the housing, an air convection passage, and a guide member. The air convection passage extends through a space between the dry printing unit and side walls of the housing as well as through openings in a top wall of this housing. Convection air flows through the air convection passage to prevent the handle portion from being heated by the dry printing unit. The guide member is telescopically mounted in the open lower end of the housing between extended and retracted positions and is spring-biased toward the extended position. In operation, the guide member is applied to the surface to be dry printed and pressure is manually applied to the handle portion to telescopically move the housing and dry printing unit about the guide member until the dry printing unit reaches the surface to be dry printed. The guide member may comprise a tubular member or a generally rectangular windowed bottom plate telescopically mounted in the housing.

9 Claims, 5 Drawing Sheets

PORTABLE HAND-HELD MANUALLY OPERATED DRY PRINTING APPARATUS

BACKGROUND OF THE INVENTION

1. Field of the Invention:

The present invention relates to a portable hand-held manually operated apparatus for performing dry printing on miscellaneous surfaces and objects, for example to dry print identification indicia for trade branding or to discourage theft.

2. Brief Description of the Prior Art:

No practical solutions to this kind of problem have been proposed in the prior art. Although hot embossing is a well known process, most traditional hot printing machines have been relying on C-shaped frames provided with a lower platen on which the workpiece must be positioned to carry out the printing operation. Such a hot printing machine is disclosed in U.S. Pat. No. 4,628,810 (Chan) issued on Dec. 16, 1986, showing a C-shaped press bringing a heated die in indirect contact with the workpiece through an embossing film. The combination of heat and pressure applied to the film causes the transfer to the surface of the workpiece of a part of a transfer material coating the film. Some embossing of the workpiece surface may also be performed as a function of the process parameters, such as temperature, pressure and application time, to create a more durable marking.

Although the prior art apparatus as described in U.S. Pat. No. 4,628,810 enables application of a high force to produce the pressure required for proper printing and embossing on the workpiece surface, it presents the following drawbacks:

- it produces a limited stroke and restricts the size of the workpiece since that workpiece has to be inserted between the die and the platen;
- it is always required to bring the workpiece to the workstation; and
- its rigid assembly does not provide for self-adjustment to sloped or non planar surface, thus yielding an uneven pressure to the surface and poor printing quality.

U.S. Pat. No. 4,181,560 granted to Maitland on January 1$^{st}$, 1980 shows a marking device featuring an open-ended housing and accepting a hot die foil stamping head. Still, this marking device is intended for mechanical operation and lacks appropriate film reel management, temperature control, and any other feature that would enable manual operation thereof, so that it could be brought to a site to mark objects in variable locations and positions without having to move these objects.

U.S. Pat. No. 4,904,334 (Honma et al.) granted on Feb. 27, 1990 discloses a hand-held manually operated apparatus for applying a transfer material on an image portion of a photocopy. A ribbon made of a film including transfer material is first brought into contact with the surface of the photocopy by a downward vertical displacement of a heated flat plate, which heated flat plate is subsequently sled over the film to apply the transfer material onto the desired area of the photocopy. Obviously, this apparatus has not been designed for printing and embossing operations due mainly to the absence of a replaceable embossing die and temperature control to provide adequate printing temperature for different films and workpiece materials or desired embossing depth. Also, such an apparatus does not provide the operator with a visual feedback to properly position an eventual printing die so as to print an indicia at a precise location on a workpiece. Moreover, the free end of the ribbon is not properly held to permit lifting and repositioning of the apparatus after each printing operation. Still, cutting of the ribbon is only possible after final use of the apparatus, by using a serrated portion of the closure cap.

The above discussed prior art demonstrates that no reasonably practical solution to the problem of hot embossing on miscellaneous objects in the field of identification or for any other purpose has been provided yet.

OBJECTS OF THE INVENTION

An object of the present invention is therefore to overcome the limitations and drawbacks of the above discussed prior art.

Another object of the present invention is to provide a portable hand-held manually operated dry printing apparatus that is light, compact and portable to allow a user to easily perform a professional quality dry printing at the client's site, by moving the apparatus to and at any position around the objects rather than moving the objects.

A third object of the present invention is to provide a portable hand-held manually operated dry printing apparatus comprising an open-ended structure permitting dry printing on objects of any size.

A fourth object of the present invention is to provide a portable hand-held manually operated dry printing apparatus in which the heat generated by the heating element is dissipated so that the temperature of the handle(s) will remain sufficiently low to enable, at all time, comfortable manipulation.

A further object of the invention is to provide a portable hand-held manually operated dry printing apparatus featuring an ergonomic design to provide comfortable operation using one or both hands and visual feedback for accurate positioning, application of the proper pressure intensity and adaptability to inclinations and a certain degree of irregularity of the workpiece surface.

A sixth object of the present invention is to provide a portable hand-held manually operated dry printing apparatus capable of controlling the temperature of the die over a wide range of temperatures to perform different types of dry printing and/or embossing on various surfaces made of various materials, and having a relatively low thermal inertia for rapid warm-up and temperature changes.

A still further object of the present invention is to provide a portable hand-held manually operated dry printing apparatus providing permanent guidance of an embossing ribbon to maintain the proper operational relationship with respect to the die and the workpiece surface, and comprising a continuously available ribbon cutting device.

SUMMARY OF THE INVENTION

More specifically, in accordance with the present invention, there is provided a portable hand-held manually operated dry printing apparatus comprising a frame structure, a handle portion, a dry printing unit, and an air convection passage. The frame structure has a lower portion, and the handle portion is connected to the frame structure for manually operating the dry printing apparatus. The dry printing unit is mounted to the lower portion of the frame structure and comprises a dry printing die member and a heat source for heating the die member, these die member and heat source forming a die member/heat source assembly. The air convection passage extends between the handle portion and the die member/heat source assembly. Convection air flows through this passage to prevent the handle portion from being heated by the die member/heat source assembly.

Flow of convection air through the air convection passage dissipates heat generated by the die member/heat source assembly so that the temperature of the handle portion remains sufficiently low to enable, at all time, comfortable manipulation.

In accordance with preferred embodiments:

the air convection passage is a vertically extending air convection passage in which convection air flows from bottom to top;

the frame structure has two opposite sides, and the handle portion comprises two handles mounted on the two opposite sides of the frame structure, respectively, each handle being spaced apart from the die member/heat source assembly to define the air convection passage;

the frame structure is hollow, and the two opposite sides of the frame structure are open to create an empty space between the two handles;

the portable hand-held manually operated dry printing apparatus further comprises a ribbon holder mounted on a top portion of the frame structure for supplying a dry printing ribbon, and a ribbon guiding system (a) for guiding the ribbon from the ribbon holder along a path extending between the die member and a surface on which dry printing is to be performed to transfer, by heating, material from the ribbon to that surface, and (b) for returning the ribbon back to the ribbon holder;

the ribbon holder comprises a ribbon cutter, and the ribbon is returned back to the ribbon cutter where used ribbon can be cut;

the ribbon guiding system comprises a generally rectangular bottom plate defining a window, and two end notches for positioning and guiding the ribbon in front of the window;

the die member is a dry printing and embossing die, the die member comprises an electronically programmable matrix of individual heating elements forming an array of selectively heatable pixels, the die member comprises compliant heat conductive material to adapt to an irregular surface on which dry printing is performed;

the dry printing apparatus comprises a housing forming the frame structure, this housing being shaped to define the handle portion and being made of molded plastic material; and the housing comprises a top wall with openings, side walls, and an open lower end to receive the die member/heat source assembly, and the air convection passage extends through a space between the side walls and the die member/heat source assembly, and the openings of the top wall.

Also in accordance with the present invention, there is provided a portable hand-held manually operated dry printing apparatus comprising a frame structure, a handle portion, a dry printing unit and a guide member. The frame structure has a lower portion, and the handle portion is connected to the frame structure for manually operating the dry printing apparatus. The dry printing unit is mounted to the lower portion of the frame structure and comprises a dry printing die member and a heat source for heating the die member. The guide member guides the die member toward a surface to be dry printed, and it is telescopically mounted on the frame structure between extended and retracted positions. Also, the guide member is spring-biased toward the extended position. In operation, the handle portion is grasped, the guide member is applied to the surface to be dry printed, and pressure is manually applied to the handle portion to telescopically move the frame structure and dry printing unit about the guide member until the heated die member is applied to the surface to be dry printed.

By guiding the die member toward the surface to be dry printed, the guide member enables more precise dry printing to obtain dry printing of better quality.

According to a preferred embodiment of the portable hand-held manually operated dry printing apparatus, the die member is a dry printing and embossing die, and the dry printing apparatus comprises first and second stop members on the guide member and frame structure, respectively. The first and second guide members abut against each other to stop the telescopic stroke at the retracted position to thereby control the depth of embossing.

According to another preferred embodiment:

the portable hand-held manually operated dry printing apparatus comprises a housing forming the frame structure, shaped to define the handle portion, and comprising a top wall and an open lower end to receive the heat source, the die member and the guide member;

the guide member comprises a tubular member telescopically mounted in the open lower end between the extended and retracted positions;

the guide member comprises a lower end to be applied to the surface to be dry printed, and a spring member is interposed between the tubular member and the top wall of the housing for spring-biasing the tubular member toward the extended position;

the tubular member comprises a top wall, the top wall of the housing is provided with a threaded hole, the dry printing apparatus further comprises a threaded rod screwed into the threaded hole of the top wall of the tubular member, and the threaded rod comprises a lower free end for abutting against the top wall of the tubular member to limit the stroke of the tubular member in the housing, whereby the amplitude of this stroke is adjusted by adjusting the longitudinal position of the threaded rod in the threaded hole; and the tubular member comprises two opposite openings, the housing comprises two opposite, inner protuberances extending in the two openings, respectively, the protuberances have smaller dimensions compared to the openings to enable telescopic movement of the tubular member in the housing between the extended and retracted positions, and the respective dimensions of the openings and protuberances determine the maximum amplitude of the telescopic movement of the tubular member in the housing.

According to a further preferred embodiment of the portable hand-held manually operated dry printing apparatus:

the guide member comprises a generally rectangular bottom plate defining a window, and a pair of parallel, spaced apart posts for mounting the generally rectangular bottom plate on the frame structure;

the parallel, spaced apart posts are (a) telescopically mounted on the frame structure between the extended and retracted positions, and (b) spring biased toward the extended position by spring members interposed between the posts and the frame structure whereby (a) the posts are slidable on the frame structure from the extended position to the retracted position against the force exerted by the spring members to apply the die member to the surface to be dry printed through the window, and (b) the force exerted by the spring members returns the telescopic posts from the retracted position to the extended position after the dry printing operation is completed;

the portable hand-held manually operated dry printing apparatus comprises stop members mounted on the posts and abutting against the frame structure to limit a downward stroke of the die member;

the portable hand-held manually operated dry printing apparatus comprises means for adjusting the position of the stop members along the posts to thereby adjust the downward stroke.

The objects, advantages and other features of the present invention will become more apparent upon reading of the following non restrictive description of preferred embodiments thereof, given by way of example only with reference to the accompanying drawings.

DETAILED DESCRIPTION OF THE PREFERRED EMBODIMENT

First Preferred Embodiment

Figure 1:
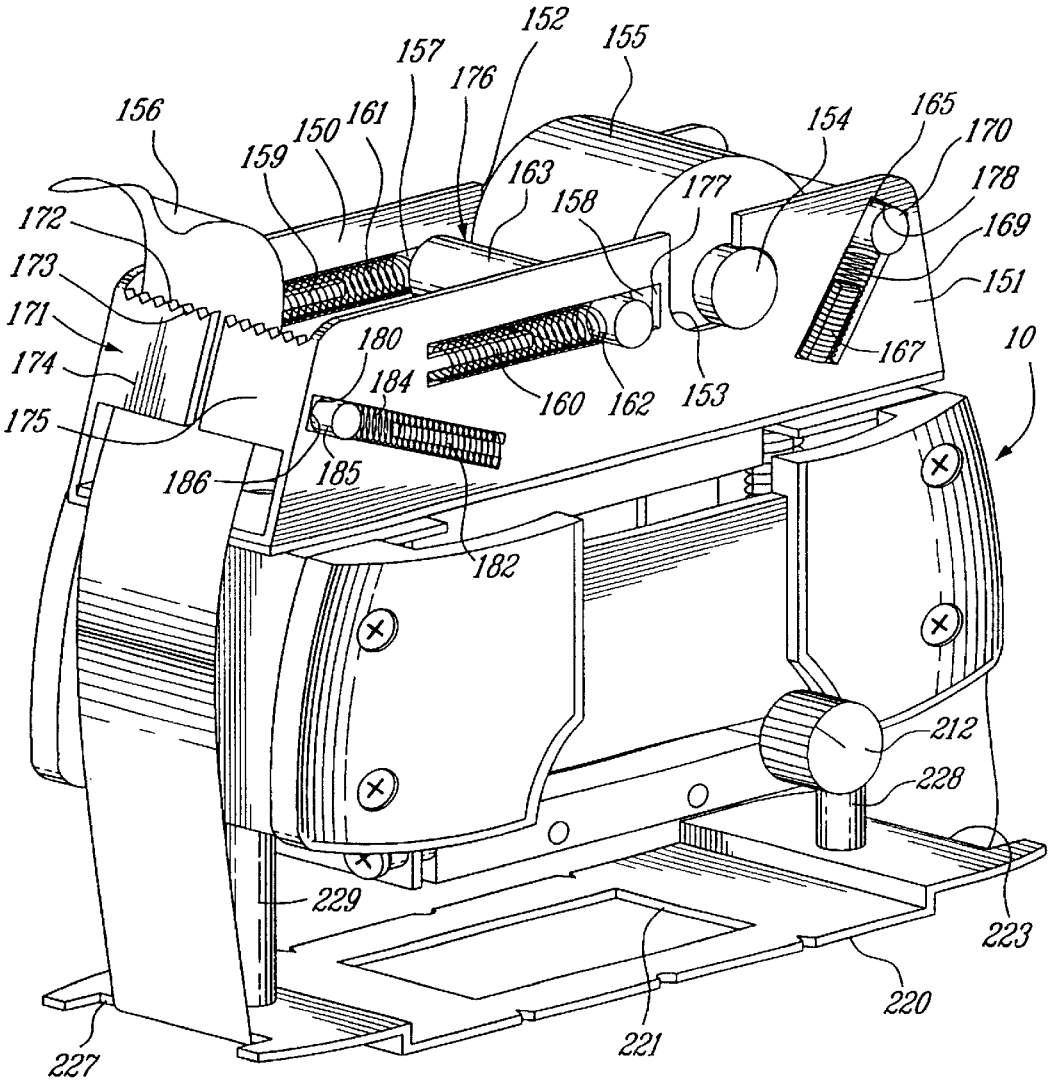
FIG. 1 is an isometric view of a preferred embodiment of the portable hand-held manually operated dry printing apparatus in accordance with the present invention.

Referring to the appended drawings, the portable hand-held manually operated dry printing apparatus is generally identified by the reference 10.

The portable hand-held manually operated dry printing apparatus 10 comprises a box-like frame 11. Mounted on the frame 11 are two handles 12 and 13, a ribbon holder 14 and a dry printing unit 15.

Figure 2:
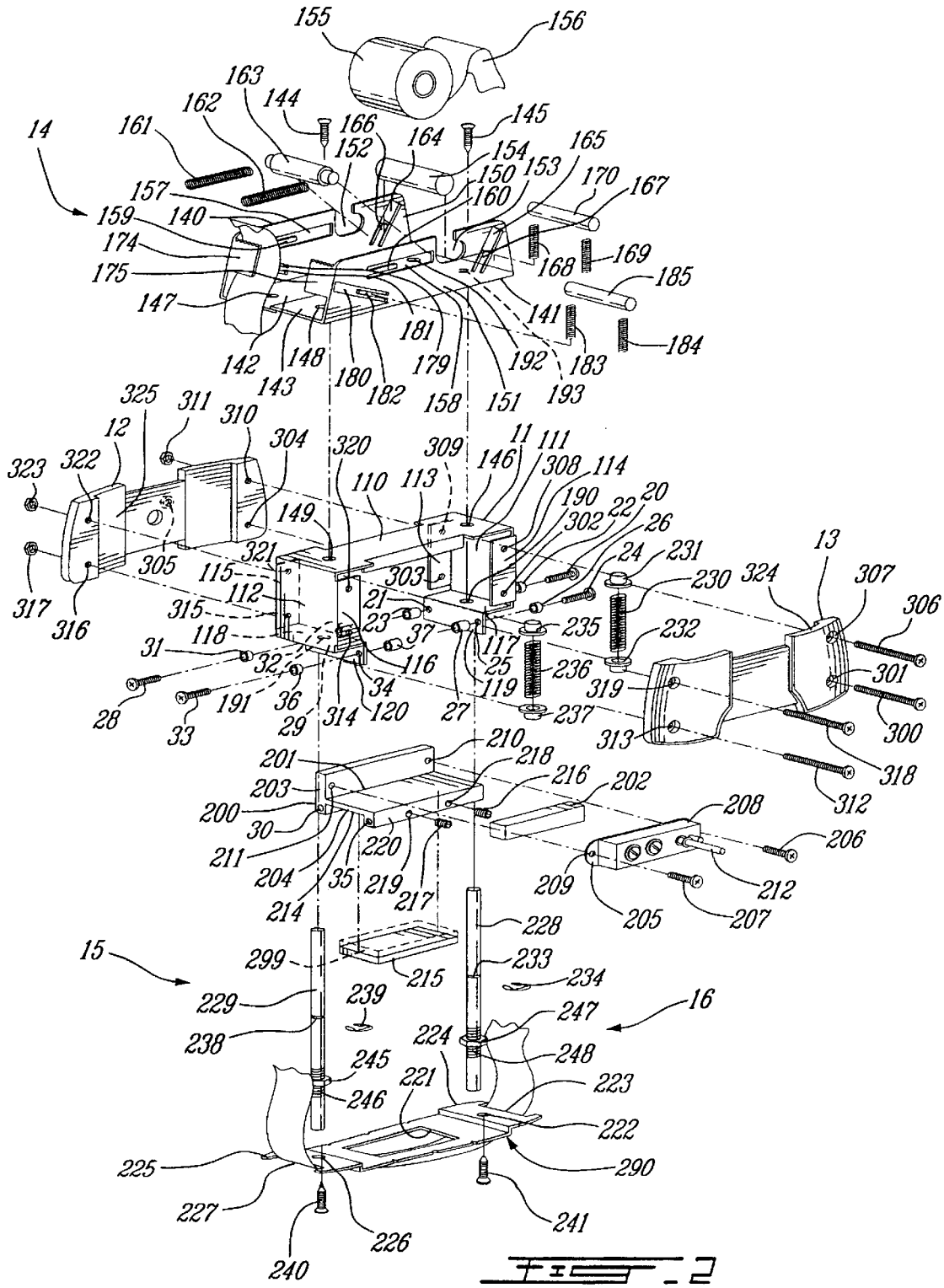
FIG. 2 is an isometric, exploded view of the portable hand-held manually operated dry printing apparatus of FIG. 1, showing the various parts thereof as well as their relationship.

Box-like frame 11:

As shown in FIG. 2, the frame 11 is made of sheet metal, for example sheet steel. The sheet metal is bent as illustrated in FIG. 2 to define a top planar wall 110, a front vertical wall 11 1, a rear vertical wall 112, side vertical tabs 113–116, bottom wall portions 117 and 118 and vertical bottom tabs 119 and 120. As can be seen, the two sides and the bottom of the box-like frame are open.

Ribbon holder:

The ribbon holder 14 comprises first and second holder sections 140 and 141 each having a right angle cross section. The holder section 140 comprises a flat horizontal base 142 applied to the top face of planar wall 110. In the same manner, the holder section 141 comprises a flat horizontal base 143 applied to the top face of the flat horizontal base 142. In other words, the flat horizontal bases 142 and 143 are superposed and then fastened to the top planar wall 110 by means of two screws 144 and 145 driven through the flat horizontal bases 142 and 143 and through the top planar wall 110.

The holder sections 140 and 141 further comprise vertical, upwardly extending flat walls 150 and 151, respectively. The flat walls 150 and 151 comprise a pair of L-shaped slots 152 and 153 to receive the respective ends of an axle 154. The function of the axle 154 is to support a roll 155 of dry printing ribbon 156.

The vertical, upwardly extending flat walls 150 and 151 comprise respective, symmetrical and horizontal slots 157 and 158. Slot 157 is provided with a longitudinal tongue 159 at the end of the slot 157 opposite to the L-shaped slot 152. In the same manner, slot 158 is provided with a longitudinal tongue 160 at the end of the slot 158 opposite to the L-shaped slot 153. A helical spring 161 is placed in the slot 157 on the tongue 159. In the same manner, a helical spring 162 is placed in the slot 158 on the tongue 160. Finally, a roller 163 comprises a first smaller diameter end inserted in slot 157 between the free end of the spring 161 and the non tongued end 176 (FIG. 1) of the slot 157, and a second smaller diameter end inserted in slot 158 between the free end of the spring 162 and the non tongued end 177 (FIG. 1) of the slot 158. As can be appreciated, the compression force of the springs 161 and 162 will apply the roller 163 to the roll 155 to retain the axle 154 in the L-shaped slots 152 and 153, and to produce a slight friction force against rotational movement of the roll 155 and thereby prevent undesired unwinding of the ribbon 156. Of course, it will be possible, by compressing the helical springs 161 and 162, to remove axle 154 from the L-shaped slots 152 and 153 to replace, for example, an empty roll 155 by a new fresh roll of dry printing ribbon.

Figure 3A:
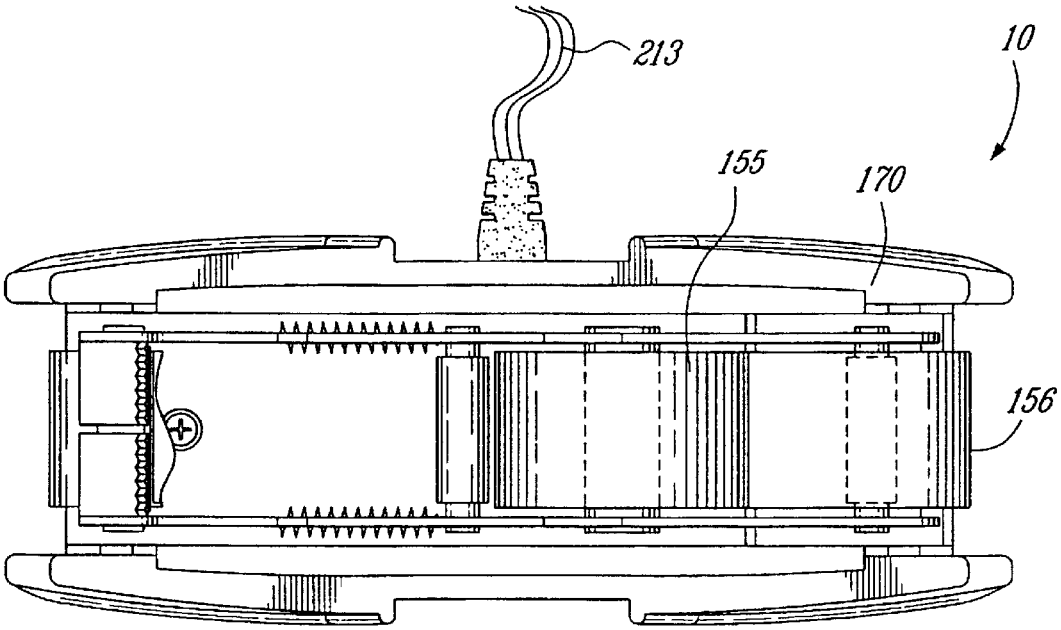
FIG. 3*a* is a top plan view of the portable hand-held manually operated dry printing apparatus of FIG. 1.

The vertical, upwardly extending flat walls 150 and 151 comprise respective, front symmetrical and oblique slots 164 and 165 located on the side of the L-shaped slots 152 and 153 opposite to the slots 157 and 158. Slot 164 is provided with a longitudinal tongue 166 at the lower end thereof. In the same manner, slot 165 is provided with a longitudinal tongue 167 at the lower end thereof. A helical spring 168 is placed in the slot 164 on the tongue 166. In the same manner, a helical spring 169 is placed in the slot 165 on the tongue 167. Finally, a roller 170 comprises a first end inserted in slot 164 between the free end of the spring 168 and the non tongued upper end of the slot 164, and a second end inserted in slot 165 between the free end of the spring 169 and the non tongued end 178 (FIG. 1) of the slot 165. As can be appreciated, the compression force of the springs 168 and 169 will apply the roller 170 to the non tongued upper ends of the slots 164 and 165, respectively. As illustrated in FIG. 3*a*, ribbon 156 unrolled from roll 155 passes above roller 170 to facilitate supply of this ribbon, as will become apparent to those of ordinary skill in the art upon reading the following description.

Referring back to FIG. 2, the free end of the ribbon 156 is returned to the rear portion of the ribbon holder 14, more specifically to a ribbon cutter 171. As illustrated in FIG. 1, the ribbon cutter 171 is formed with a cutting edge 172 comprising a plurality of triangular teeth such as 173 to cut used ribbon. The ribbon cutter 171 is formed of an end, right angle extension 174 (FIGS. 1 and 2) of the vertical, upwardly extending flat wall 150, and an end, right angle extension 175 (FIGS. 1 and 2) of the vertical, upwardly extending flat wall 151. FIG. 1 shows that the free end of the ribbon 156 passes behind the cutter 171.

The vertical, upwardly extending flat walls 150 and 151 comprise respective, rear symmetrical and oblique slots 179 and 180 located in the proximity of the ribbon cutter 171. Slot 179 is provided with a longitudinal tongue 181 at the lower end thereof. In the same manner, slot 180 is provided with a longitudinal tongue 182 at the lower end thereof. A helical spring 183 is placed in the slot 179 on the tongue 181. In the same manner, a helical spring 184 is placed in the slot 180 on the tongue 182. Finally, a roller 185 comprises a first end inserted in slot 179 between the free end of the spring 183 and the non tongued upper end of the slot 179, and a second end inserted in slot 180 between the free end of the spring 184 and the non tongued end 186 (FIG. 1) of the slot 180. As can be appreciated, the compression force of the springs 183 and 184 in cooperation with the roller 185 will apply the dry printing ribbon 156 to the inner face of the ribbon cutter 171. The pressure applied to the ribbon 156 by the springs 183 and 184 will cause resistance to sliding of the ribbon 156 on the inner face of the right angle extensions 174 and 175 to normally retain the free end of the ribbon 156 while allowing manual pulling of that ribbon 156.

Alternatively, used ribbon 156 could be manually or automatically winded onto a roller (not shown) rotatably mounted on the ribbon holder 14.

Dry printing unit:

The dry printing unit 15 comprises a heat-conductive plate member 200 having a h-shaped cross section. The h-shaped plate member 200 has a larger vertical wall 203 and a horizontal wall 204 defining an upper 90° corner 201 in which an electric heating element 202 is placed. An adjustable thermostat 208 is mounted on the top face of the horizontal wall 204 adjacent to the heating element 202 on the side opposite to corner 201. The housing of the thermostat 208 is elongated and comprises end tabs such as 205. Two screws 206 and 207 are inserted in holes such as 209 of the two end tabs such as 205 and driven into respective threaded holes 210 and 211 of the vertical wall 203 to fasten the thermostat 208 to the h-shaped plate member 200 with the heating element 202 squeezed between the housing of the thermostat 208 and the vertical wall 203.

The thermostat 208 comprises a rotatable knob 212 to adjust the level of temperature produced by the heating element 202. The operation of a thermostat is well known to those of ordinary skill in the art and, accordingly, will not be further described in the present specification.

Also, although the electrical connections between the thermostat 208, the heating element 202 and the electric supply cord 213 (FIGS. 3*a* and 3*c*) are not illustrated, such connections are well known to those of ordinary skill in the art and will not be further described.

It is also within the scope of the present invention to replace the electric heating element 202 and the associated thermostat 208 by other types of heat source and temperature control, such as a gas (butane) burner, etc.

The h-shaped plate member 200 defines an underside cavity 214, presenting the general shape of a parallelepiped. A dry printing die member 215 is placed in the cavity 214 and fixed in this cavity 214 through a pair of set screws 216 and 217 respectively driven in a pair of threaded holes 218 and 219 of the smaller vertical wall 220 of the h-shaped plate member 200.

Figure 3B:
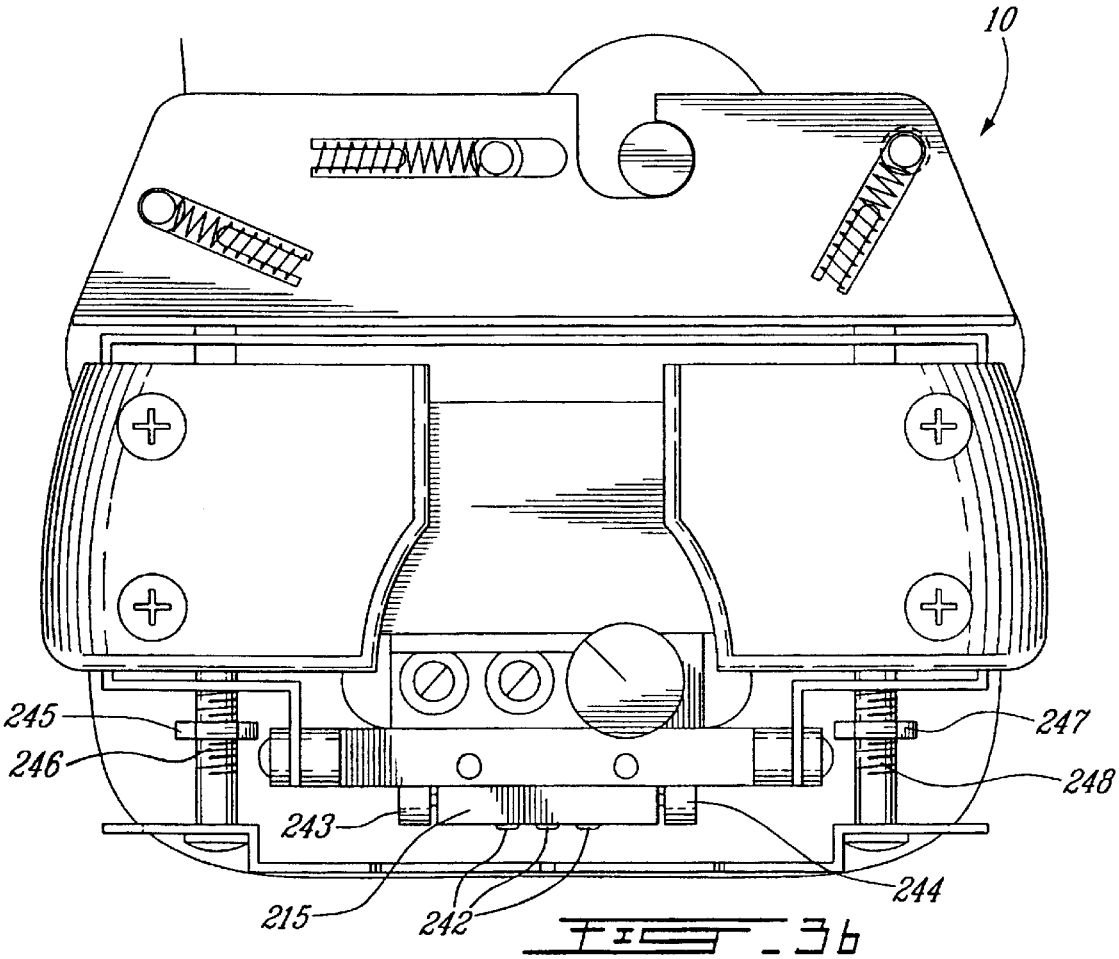
FIG. 3*b* is a right side elevational view of the portable hand-held manually operated dry printing apparatus of FIG. 1.
Figure 3C:
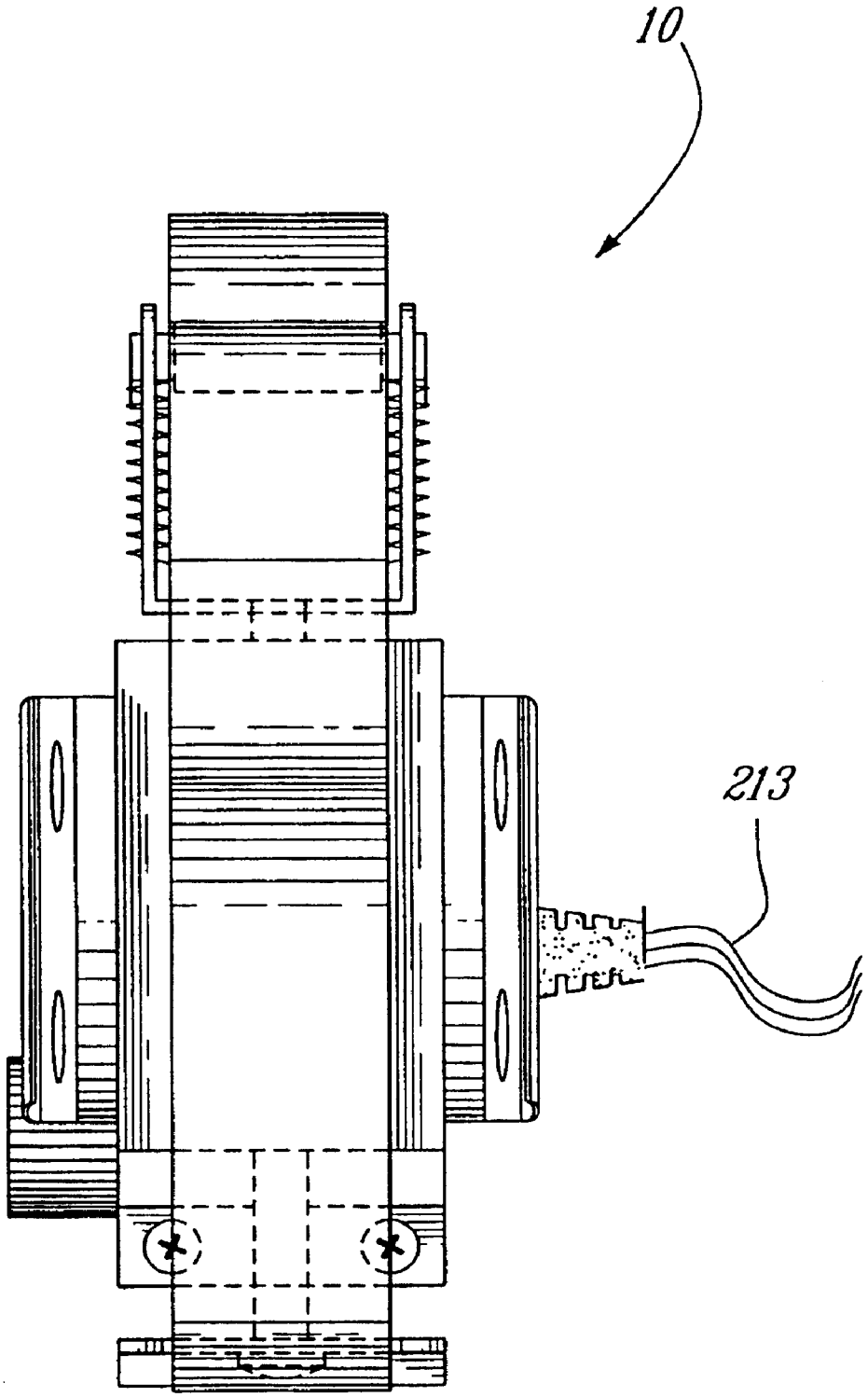
FIG. 3*c* is a front elevational view of the portable hand-held manually operated dry printing apparatus of FIG. 1.

The dry printing die member 215 may be formed with a relief 242 for embossing the surface of an object during the dry printing operation. As shown in FIG. 3*b* and in addition to the relief 242, the die member 215 can include a number of rotatable wheels such as 243 and 244 bearing a peripheral series of indicia (letters, numbers, typographic symbols, iconic symbols, etc.) to be dry printed and/or embossed on the surface of the object. A specific indicia or a position having no indicia on the circumference of one wheel 243 or 244 can be selected by rotating this wheel 243 or 244 using an appropriate elongated tool such as a screwdriver.

As an alternative to the combination of fixed and manually selectable indicia of the die member 215, an electronically programmable matrix of individual heating elements can be used in cooperation with a portable micro-controller. Such a programmable heat printing matrix using hot needles or resistive elements to form the array of selectively heatable pixels are known in the art and available on the market.

The h-shaped plate member 200 is mounted to the frame as follows:

- a first screw 20 is inserted in a hole 21 of the bottom tab 119 and screwed into a corresponding threaded hole (not shown) made in the h-shaped plate member 200, with a heat resistant washer 22 mounted on the screw 20 and interposed between the head of the screw 20 and the tab 119, and a heat resistant sleeve 23 mounted on the screw 20 between the tab 119 and the h-shaped plate member 200;
- a second screw 24 is inserted in a hole 25 of the bottom tab 119 and screwed into a corresponding threaded hole (not shown) made in the h-shaped plate member 200, with a heat resistant washer 26 mounted on the screw 24 and interposed between the head of the screw 24 and the tab 119, and a heat resistant sleeve 27 mounted on the screw 24 between the tab 119 and the h-shaped plate member 200;
- a third screw 28 is inserted in a hole 29 of the bottom tab 120 and screwed into a corresponding threaded hole 30 made in the h-shaped plate member 200, with a heat resistant washer 31 mounted on the screw 28 and interposed between the head of the screw 28 and the tab 120, and a heat resistant sleeve 32 mounted on the screw 28 between the tab 120 and the h-shaped plate member 200; and
- a fourth screw 33 is inserted in a hole 34 of the bottom tab 120 and screwed into a corresponding threaded hole 35 made in the h-shaped plate member 200, with a heat resistant washer 36 mounted on the screw 33 and interposed between the head of the screw 33 and the tab 120, and a heat resistant sleeve 37 mounted on the screw 33 between the tab 120 and the h-shaped plate member 200.

Guide member:

Finally, the dry printing apparatus 10 comprises a guide member 16 for guiding the dry printing unit toward a surface to be dry printed and/or embossed. The guide member 16 includes a generally rectangular bottom plate 290 formed with a generally rectangular, generally central window 221, a first end tab 224 formed with a hole 222 and a wide rectangular end notch 223 forming a ribbon guide. The generally rectangular bottom plate 290 further comprises a second end tab 225 opposite to the first end tab 224 and formed with a hole 226 and a wide rectangular end notch 227 forming a ribbon guide.

The generally rectangular bottom plate 290 is associated with a set of two posts 228 and 229 telescopically mounted on the frame 110. The first end tab 224 is fastened to the lower end of the post 228 by means of a screw 241 passing through the hole 222 and screwed in an axial threaded hole (not shown) made in the bottom face of the post 228. In the same manner, the second end tab 225 is fastened to the lower end of the post 229 by means of a screw 240 passing through the hole 226 and screwed in an axial threaded hole (not shown) made in the bottom face of the post 229.

A top bushing 231 is mounted in hole 146 of top planar wall 10, and a bottom bushing 232 is mounted in hole 190 of bottom wall portion 117. Post 228 is inserted through bottom bushing 232, top bushing 231, hole 192 of flat horizontal base 142 and hole 193 of flat horizontal base 143. Bushings 231 and 232 and holes 192 and 193 are coaxial to enable longitudinal sliding of the post 228 therein.

A helical spring 230 is mounted on the post 228 between the top bushing 231 and the bottom bushing 232. Post 228 further comprises a circular groove 233 to receive a spring clip 234 located between the bottom bushing 232 and the lower end of the spring 230. The spring clip 234 will rest on the top face of bushing 232 to limit the downward stroke of the post 228 and thereby hold this post 228 in the bushings 231 and 232 and in the holes 192 and 193.

The outer surface of the post 228 has a threaded portion 248 on which an threaded nut 247 is engaged.

A top bushing 235 is mounted in hole 149 of top planar wall 110, and a bottom bushing 237 is mounted in hole 191 of bottom wall portion 118. Post 229 is inserted through bottom bushing 237, top bushing 235, hole 147 of flat horizontal base 142 and hole 148 of flat horizontal base 143. Bushings 235 and 237 and holes 147 and 148 are coaxial to enable longitudinal sliding of the post 229 therein.

A helical spring 236 is mounted on the post 229 between the top bushing 235 and the bottom bushing 237. Post 229 further comprises a circular groove 238 to receive a spring clip 239 located between the top surface of the bottom bushing 237 and the lower end of the spring 236. The spring clip 239 will rest on the top face of bushing 237 to limit the downward stroke of the post 229 and thereby hold this post 229 in the bushings 235 and 237 and in the holes 147 and 148.

The outer surface of the post 229 has a threaded portion 246 on which a threaded nut 245 is engaged.

A nut 245 engaged on a threaded portion 246 of the post 229 and a nut 247 engaged on a threaded portion 248 of the post 228 constitute stop members longitudinally adjustable along the posts 228 and 229 to adjust the downward stroke of the die member 215 and thus the embossing depth. More specifically, nuts 245 and 247 apply to the underside of the wall portions 118 and 117, respectively, to limit the downward stroke of the die member 215 and thus the embossing depth. Other alternative embodiments such as a ring member (not shown) with a set screw (not shown) could be used in the place of the nuts 245 and 247.

Handles 12 and 13:

The handles 12 and 13 are mounted on the frame 11 as follows:

- a first screw 300 is inserted through a hole 301 of the handle 13, a hole 302 of the tab 114, a hole 303 of the tab 113 and a hole 304 of the handle 12, and a nut 305 is finally driven onto the end of the screw 300 on the outer side of the handle 12;
- a second screw 306 is inserted through a hole 307 of the handle 13, a hole 308 of the tab 114, a hole 309 of the tab 113 and a hole 310 of the handle 12, and a nut 311 is finally driven onto the end of the screw 306 on the outer side of the handle 12;
- a third screw 312 is inserted through a hole 313 of the handle 13, a hole 314 of the tab 116, a hole 315 of the tab 115 and a hole 316 of the handle 12, and a nut 317 is finally driven onto the end of the screw 312 on the outer side of the handle 12; and
- a fourth screw 318 is inserted through a hole 319 of the handle 13, a hole 320 of the tab 116, a hole 321 of the tab 115 and a hole 322 of the handle 12, and a nut 323 is finally driven onto the end of the screw 318 on the outer side of the handle 12.

As illustrated in FIG. 2, a vertically extending air convection passage is defined between the inner face of each handle 12,13 and the box-like frame 11. Accordingly, each handle 12,13 is spaced apart from the heat source (for example the electric element 202 and thermostat 208), the heated h-shaped plate member 200, and the heated die member 215 to define an air convection passage between these handles 12 and 13, and these heat source, h-shaped plate member, and die member to thereby ventilate the inner face of each handle 12,13 and dissipate heat produced by the heat source. This prevents the handles 12 and 13 from being heated and enables comfortable manipulation at all time.

Since the two sides of the hollow box-like frame 11 are open, the empty space located in the hollow box-like frame 11 between the two handles 12 and 13 is also ventilated.

Operation of the portable hand-held manually operated dry printing apparatus 10 will now be described.

As a preliminary step, ribbon 156 is pulled and unrolled from roll 155, is passed through the ribbon guiding notches 223 and 227 to guide the ribbon 156 in front of the window 221 at all time, and is finally passed between roller 185 and ribbon cutter 171. If desired ribbon 156 is cut by means of the cutting edge 172.

The cord 213 is then plugged into an electric outlet (not shown) and the knob 212 is adjusted to obtain the desired temperature of the printing and embossing die member 215.

The portable hand-held manually operated dry printing apparatus 10 is then grasped by the user and the generally rectangular bottom plate 290, and therefore the ribbon 156 is applied to the article with the window 221 on the area to be dry printed and embossed. Accordingly, the generally rectangular bottom plate 290 and the window 221 constitute means for visually selecting the area where dry printing is performed; the spacing between the generally rectangular bottom plate 290 and the two handles 12 and 13 defines lower open side windows enabling an operator to visually select the area on which dry printing is performed. Pressure is then applied toward the object to compress the helical springs 230 and 236, and slide the telescopic posts 228 and 229 in the set of coaxial holes 190, 146, 192 and 193 and the set of coaxial holes 191, 149, 147 and 148, respectively. The helical springs 230 and 236 are compressed until the nuts (stop members) 245 and 247 rest on the underside of the bottom walls portions 118 and 117, respectively, to apply the dry printing and/or embossing die member 215 through the window 221 to the area on which dry printing and/or embossing is to be performed while controlling the depth of embossing by abutment of the nuts 245 and 247 on the underside of the wall portions 118 and 117, respectively; again the spacing between the generally rectangular bottom plate 290 and the handles 12 and 13 defines lower open side windows enabling an operator to visually see and appropriately manually control the dry printing and/or embossing operation. The ribbon consists of a film normally made of plastic material coated on one side with heat transferrable material the latter being applied, during the dry printing operation to the surface on which dry printing is performed; this type of ribbon is well known to those of ordinary skill in the art. The heated die member 215 will then apply the portion of the ribbon 156 located in front of the window 221 to the selected area of the object to thereby dry print and eventually emboss that article. Then, coating material will be transferred from the film to the surface of the object. The time of application of the die member 215 can widely vary in relation to various parameters such as the nature of the material forming the ribbon 156, the temperature of the die member 215, the nature of the material of the object on which dry printing and possibly embossing is performed, etc. The portable hand-held manually operated dry printing apparatus 10 is particularly well adapted to embossing of plastic surfaces.

To conclude the description of this first preferred embodiment, the ribbon holder 14 and the two handles 12 and 13 could be replaced by a housing (not shown) made, for example, of molded plastic material. The housing can be shaped to define a handle portion (not shown) that can be grasped by the user to manipulate the portable hand-held manually operated dry printing apparatus 10. Finally, the inner face of the housing will be spaced apart from the assembly including the heat source (for example the electric element 202 and thermostat 208), the heated h-shaped plate member 200, and the heated die member 215 and will comprises a top wall (not shown) provided with openings to define the vertically extending air convection passage in view of ventilating the inner face of housing and dissipate heat produced by the heat source. This will prevent the handle portion from being heated and will enable comfortable manipulation of the apparatus 10 at all time.

The portable hand-held manually operated dry printing apparatus 10 presents, amongst others, the following advantages:

- the portable hand-held manually operated dry printing apparatus is light, compact and portable to perform easy and professional quality branding of objects at the client's site, at any position on the objects without having to displace the objects;
- the portable hand-held manually operated dry printing apparatus comprises an open-ended structure, i.e. a telescopic, generally rectangular plate member 290 with a window 221 to permit dry printing and embossing of objects of any size;
- the empty spaces provided within the box-like frame 11, and the empty spaces between (a) the handles 12 and 13 and (b) the box-like frame and the heating assembly including the h-shaped plate member 200, the heating element 202 and thermostat 208, and the die member 215 dissipate heat, advantageously by natural convection, so that temperature of the handles 12 and 13 will remain sufficiently low to enable, at all time, comfortable manipulation;
- the depth of embossing is automatically controlled by abutment of the nuts 245 and 247 on the underside of the wall portions 118 and 117, respectively; the depth of embossing can therefore be adjusted through longitudinal adjustment of the position of the nuts 245 and 247 along the threaded post portions 246 and 248, respectively;
- the portable hand-held manually operated dry printing apparatus 10 has an ergonomic design to provide comfortable operation using both hands and visual feedback for accurate positioning, application of the proper pressure intensity;
- a layer (see 299 in FIG. 2) of generally compliant and resilient heat conductive material such as silicone can be interposed between the die member 215 and the bottom of the cavity 214 of the h-shaped plate member 200 to obtain an optimal adaptability of the portable hand-held manually operated dry printing apparatus 10 to the relief of the surface of the object to be dry printed and embossed;

alternatively, the die member can be coated or completely formed with such generally compliant and resilient heat conductive material with the same advantage;

- the portable hand-held manually operated dry printing apparatus 10 comprises a thermostat 208 for controlling the temperature of the printing and embossing die member 215 over a wide range of temperatures to perform different types of dry printing and embossing on various surfaces made of various materials, and having a relatively low thermal inertia for rapid warm-up and temperature changes; and
- the portable hand-held manually operated dry printing apparatus 10 comprises wide rectangular notches 223 and 227 providing permanent guidance of the embossing ribbon 156 to maintain the proper operational relationship with respect to the die member and the workpiece surface, and comprising a continuously available ribbon cutting device 171.

Second Preferred Embodiment

Figure 4:
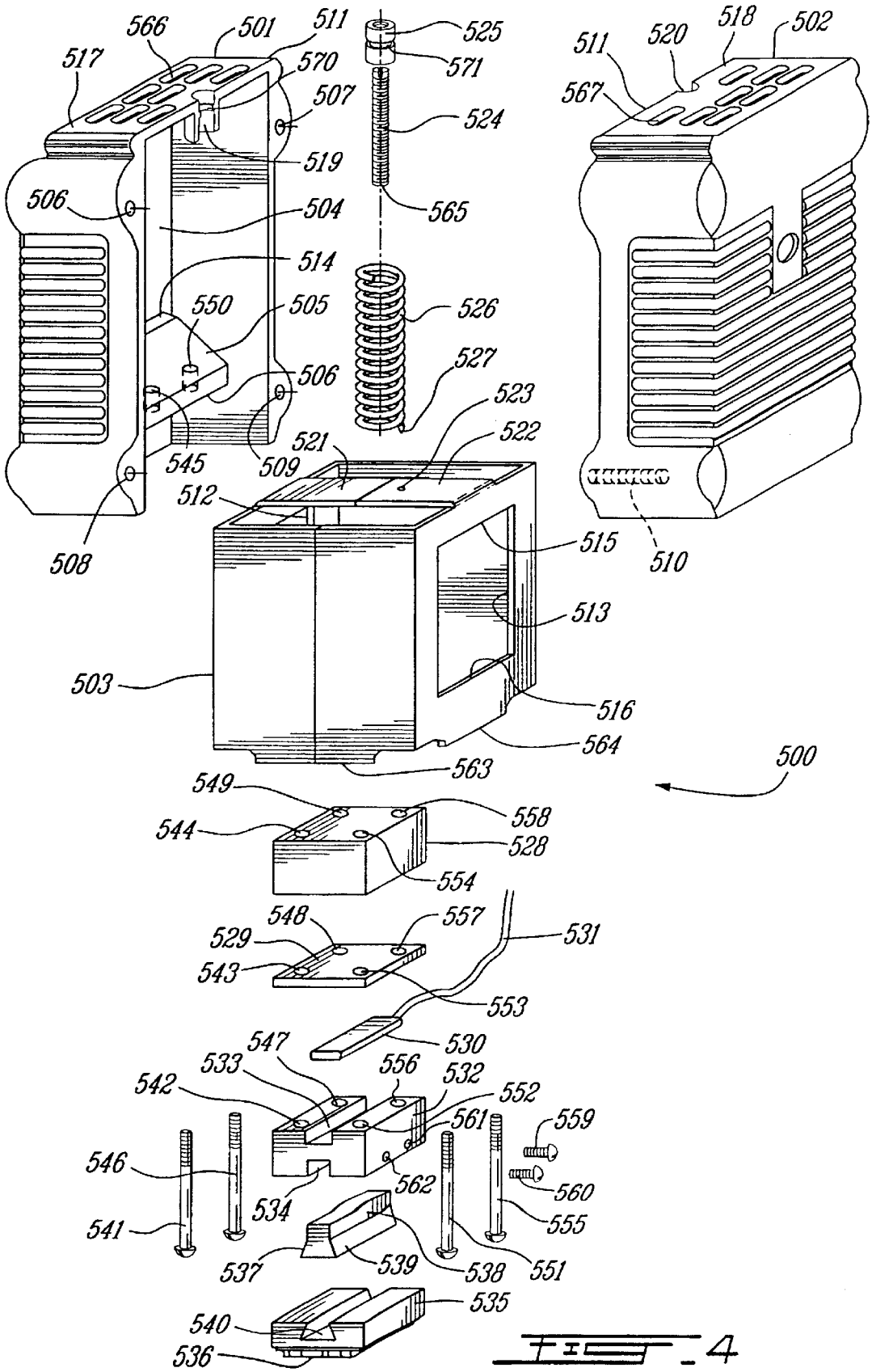
FIG. 4 is an isometric, exploded view of a second preferred embodiment of the portable hand-held manually operated dry printing apparatus in accordance with the present invention, showing the various parts thereof as well as their relationship.

Referring to FIG. 4 of the appended drawings, the second preferred embodiment of the portable hand-held manually operated dry printing apparatus according to the present invention is generally identified by the reference 500.

The portable hand-held manually operated dry printing apparatus 500 comprises a first half housing portion 501, a second half housing portion 502, and a sliding box-like tubular guide member 503. Preferably, the first and second housing portions 501 and 502 are made of molded plastic material while the guide member 503 is made of sheet metal.

Each housing portion 501,502 comprises an inner face such as 504 on which a bridge section such as 505 is molded integrally with the plastic material of the housing portion 501,502. The two bridge sections such as 505 of the housing portions 501 and 502 are symmetrical to each other and have a generally triangular cross section. Each bridge section such as 505 also comprises a free end face such as 506.

The housing portions 501 and 502 are assembled together by means of four screws (not shown) inserted in four (4) respective holes 506–509 of the housing portion 501 to be finally screwed in four respective threaded holes such as 510 of the housing portion 502. When the two housing portions 501 and 502 are assembled together, the two free end faces such as 506 of the bridge portions such as 505 of the two housing portions 501 and 502 confront each other whereby these two bridge portions form a dry printing unit supporting member.

The sliding box-like guide member 503 has a horizontal cross section dimensioned to enable easy vertical sliding of that guide member 503 into the housing 511 formed by the assembled housing portions 501 and 502. The sliding box-like guide member 503 comprises a pair of opposed rectangular openings 512 and 513. The bridge sections such as 505 of the two housing portions 501 and 502 are placed in the respective openings 512 and 513 whereby the bases such as 514 of the two bridge sections such as 505 abuts against the edge surfaces such as 515 and 516 to limit the vertical stroke of the sliding box-like guide member 503 within the housing 511.

Still referring to FIG. 4, the top wall 517 of housing portion 501 and the top wall 518 of housing portion 502 define respective halves 519 and 520 of a vertical hole comprising an annular protuberance 570. The sliding box-like guide member 503 further comprises a pair of top tabs 521 and 522 forming a top wall portion of the sliding box-like guide member 503. One of these tabs, namely tab 522, comprises a small hole 523 therein.

As illustrated in FIG. 4, an internally threaded sleeve 525 is mounted into the hole 519;520. The outer surface of the sleeve 525 is formed with an annular groove 571 to receive the annular protuberance 570 and thereby lock the sleeve 525 in the hole 519;520. A threaded rod 524 is screwed into the internally threaded sleeve 525.

A helical spring 526 is mounted on the threaded rod 524 between (a) the top wall portion of the sliding box-like guide member 503 formed by the two tabs 521 and 522 and (b) the underside of the top walls 517 and 518 of the housing portions 501 and 502. In this second preferred embodiment, the helical spring 526 is made of metallic wire having a lower end 527 inserted in the hole 523 of tab 522 to fasten the lower end of the spring 526 to the top wall portion of the sliding box-like guide member 503.

Those of ordinary skill in the art will appreciate that the spring 526 will spring-bias the sliding box-like guide member 503 downwardly until the upper edge surfaces such as 515 of the rectangular openings 512 and 513 apply to the top of the bases such as 514 of the two bridge sections such as 505, respectively.

The portable hand-held manually operated dry printing apparatus 500, further comprises:

a block 528 of heat-insulating material;

an electric element 530;

a plate 529 for covering the electric element 530, this plate 529 being made of heat-conducting metal;

a block 532 made of heat-conducting metal and comprising a top groove 533 for receiving the electric element 530, and a bottom groove;

a dry printing and embossing die member 535 comprising bottom indicia 536 to be dry printed and embossed, and a top groove 540 fan-shaped in cross-section; and a bar 537 defining a first tongue 539 fan-shaped in crosssection to form a dovetail joint with groove 540, and a second tongue 538 with a rectangular cross section to fit in groove 534.

Assembly first comprises positioning the electric element 530 in groove 533. Then a first screw 541 is inserted in hole 542 of block 532, in hole 543 of plate 529 and in hole 544 of block 528 and is finally screwed and tightened in a threaded hole 545 made in the underside of bridge portion 505. A second screw 546 is inserted in hole 547 of block 532, in hole 548 of plate 529 and in hole 549 of block 528 and is finally screwed and tightened in a threaded hole 550 made in the underside of bridge portion 505. A third screw 551 is inserted in hole 552 of block 532, in hole 553 of plate 529 and in hole 554 of block 528 and is finally screwed and tightened in a threaded hole (not shown) made in the underside of the bridge portion (not shown) such as 505 of the housing portion 502. Last of all, a fourth screw 555 is inserted in hole 556 of block 532, in hole 557 of plate 529 and in hole 558 of block 528 and is finally screwed and tightened in a threaded hole (not shown) made in the underside of the bridge portion (not shown) such as 505 of the housing portion 502.

Fan-shaped tongue 539 is press-fit in fan-shaped groove 540 to secure bar 537 to the die member 535. Rectangular tongue 538 is then inserted in groove 534. The assembly is completed by driving a pair of screws 559 and 560 in respective threaded holes 561 and 562 and by tightening the screws 559 and 560 until the tongue 538 is fixedly secured in the groove 534. Of course, both threaded holes 561 and 562 open in the groove 534 to enable the end of the screws 559 and 560 to apply pressure on the tongue 538 to lock the latter in the groove 534.

To operate the portable hand-held dry printing apparatus 500, the following steps are performed:

the housing 511 is manually grasped by the user; as can be seen in FIG. 4, housing 511 is conveniently shaped and dimensioned for being grasped with one hand although the use of both hands is recommended for optimal stability and printing quality;

lower edge surfaces such as 563 and 564 are placed around the surface to be dry printed and embossed;

the housing 511 is pressed downwardly to slide the housing 511 on the box-like guide member 503 until the lower side of the bases such as 514 of the bridge sections such as 505 of the housing portions 501 and 502 abut against the respective lower edge surfaces such as 516 of the two rectangular openings 512 and 513; downward movement of the housing 511 will allow the indicia 536 of the die member 535 to reach the surface to be dry printed and embossed, and abutment of the bases such as 514 on the lower edge surfaces such as 516 corresponds to the maximum depth of embossing of the surface, such as a plastic surface to be dry printed and embossed; and finally the housing 511 is released; the spring 526 then pushes the housing 511 upwardly until the top side of the bases such as 514 of the bridge sections such as 505 abut against the upper edge surfaces such as 515 of the respective openings 512 and 513.

The depth of embossing can be reduced by adjusting the longitudinal position of the threaded rod 524 in the threaded hole 519;520. Indeed, the lower end 565 of the threaded rod 524 can be lowered to abut against the top face of the tabs 521 and 522 before the lower side of the bases such as 514 abut against the respective lower edge surfaces such as 516 of the two rectangular openings 512 and 513. Accordingly, longitudinal adjustment of the threaded rod 524 in the threaded sleeve 525 can be used to adjust the depth of embossing by controlling the extent of displacement of the indicia 536 of the die 535 beyond the bottom edge surfaces such as 563 and 564 of the box-like guide member 503.

Heating of the housing 511 by the heating element 530 is prevented by upward convection of air within this housing 511. More specifically, air moves within the housing from bottom to top as follows:

air initially moves upwardly between the pieces 535, 532, 529 and 528 and the vertical walls of the box-like guide member 503;

air then passes through the space between the ends of the bridge sections such as 505 and the vertical walls of the box-like guide member 503;

air then passes through the space between the tabs 521 and 522 and the vertical walls of the box-like guide member 503; and air moves upwardly within the housing 511 from the tabs 521 and 522 to finally escape through openings 566 and 567 in the top walls of both housing sections 501 and 502.

In this manner, the vertically extending air convection passage enables ventilation of the inner face of the housing and dissipation of heat produced by the heat source. This will prevent the handle portion from being heated and will enable comfortable manipulation at all time.

In the foregoing description and the appended claims, the portable hand-held manually operated dry printing apparatus 10 is described using terms such as "top", "bottom", "front", "rear", "side", "lower", "upper", etc. in view of more clearly defining the positions of the various parts and elements. Of course, these terms refer to the position of the the portable hand-held manually operated dry printing apparatus 10 as illustrated in the accompanying drawings. This being said, it should be kept in mind that during operation, the portable hand-held manually operated dry printing apparatus 10 can be inverted, tilted, laid down, etc. to perform dry printing and eventually embossing on any face of an object.

Also, natural convection has been described to produce the flow of air in the air convection passage. However, it is within the scope of the present invention to produce forced air convection in this passage by means for example of a fan or ventilator.

Although the present invention has been described hereinabove by way of a preferred embodiment thereof, this embodiment can be modified at will, within the scope of the appended claims, without departing from the spirit and nature of the subject invention.

What is claimed is:

1. A portable hand-held manually operated dry printing apparatus comprising:

a housing comprising a top wall with openings, side walls, and an open lower end, said housing being shaped to define a handle portion through which the dry printing apparatus is manually operated;

a dry printing unit mounted to the open lower end of the housing with a space between the side walls and the dry printing unit, said dry printing unit comprising a dry printing die member and a heat source for heating the die member; and a guide member extending through the open lower end of the housing, being telescopically mounted in the housing between extended and retracted positions, and being spring-biased toward the extended position;

whereby, in operation:

the handle portion is grasped:

the guide member is applied to the surface to be dry printed; and pressure is manually applied to the handle portion to telescopically move the housing and dry printing unit about the guide member until the heated die member is applied to the surface to be dry printed; and whereby an air convection passage is defined through:

the space between the side walls of the housing and the dry printing unit; and the openings of the top wall of the housing.

2. A portable hand-held manually operated dry printing apparatus as recited in claim 1, wherein:

the die member is a dry printing and embossing die; and the dry printing apparatus comprises first and second stop members on the guide member and housing, respectively, said first and second stop members abutting against each other to stop the telescopic stroke at said retracted position to thereby control a depth of embossing.

3. A portable hand-held manually operated dry printing apparatus as recited in claim 2, further comprising means for adjusting the position of at least one of the stop members to adjust the amplitude of the telescopic stroke and therefore the depth of embossing.

4. A portable hand-held manually operated dry printing apparatus as recited in claim 1, wherein:

the guide member comprises a tubular member telescopically mounted in the open lower end of the housing between the extended and retracted positions;

the guide member comprises a lower end to be applied to the surface to be dry printed; and a spring member is interposed between the tubular member and the housing for spring-biasing the tubular member toward the extended position.

5. A portable hand-held manually operated dry printing apparatus as recited in claim 4, wherein:

the tubular member comprises a top wall;

the top wall of the housing is provided with a threaded hole;

the dry printing apparatus further comprises a threaded rod screwed into the threaded hole of the top wall of the housing; and the threaded rod comprises a lower free end for abutting against the top wall of the tubular member to limit the stroke of the tubular member in the housing, whereby the amplitude of said stroke is adjusted by adjusting the longitudinal position of the threaded rod in the threaded hole.

6. A portable hand-held manually operated dry printing apparatus as recited in claim 4, wherein:

said tubular member comprises two opposite openings;

said housing comprises two opposite, inner protuberances extending in the two openings of the tubular member, respectively;

the protuberances have smaller dimensions compared to the openings of the tubular member to enable telescopic movement of the tubular member in the housing between the extended and retracted positions; and the respective dimensions of the openings of the tubular member and the protuberances of the housing determine the maximum amplitude of the telescopic movement of the tubular member in the housing.

7. A portable hand-held manually operated dry printing apparatus as recited in claim 1, wherein:

the guide member comprises a bottom plate defining a window, and a pair of parallel, spaced apart posts for mounting the bottom plate on the housing;

the parallel, spaced apart posts are:

telescopically mounted on the housing between the extended and retracted positions; and spring biased toward the extended position by spring members interposed between the posts and the housing;

said posts are slidable on the housing from the extended position to the retracted position against the force exerted by the spring members to apply the die member to the surface to be dry printed through the window; and the force exerted by the spring members returns the telescopic posts from the retracted position to the extended position after the dry printing operation is completed.

8. A portable hand-held manually operated dry printing apparatus as recited in claim 7, further comprising stop members mounted on the posts to limit a downward stroke of the die member about the housing.

9. A portable hand-held manually operated dry printing apparatus as recited in claim 8, further comprising means for adjusting the position of the stop members along the posts to thereby adjust said downward stroke.

* * * * *